US012642398B2

(12) United States Patent
Kuhns et al.

(10) Patent No.: US 12,642,398 B2
(45) Date of Patent: Jun. 2, 2026

(54) SHOWER BASE OR BATHTUB

(71) Applicant: Project Soak, LLC, Irving, TX (US)

(72) Inventors: Matthew Kuhns, Canfield, OH (US); Beda Angelo Pormentilla, Jersey City, NJ (US); Corey Peterson, Bordentown, NJ (US); Jeffrey Lyn Stitt, Levittown, PA (US); Nitin S. Kolekar, Hillsborough, NJ (US)

(73) Assignee: Project Soak, LLC, Irving, TX (US)

( * ) Notice: Subject to any disclaimer, the term of this patent is extended or adjusted under 35 U.S.C. 154(b) by 111 days.

(21) Appl. No.: 18/269,628

(22) PCT Filed: Jan. 20, 2022

(86) PCT No.: PCT/US2022/013046

§ 371 (c)(1),
(2) Date: Jun. 26, 2023

(87) PCT Pub. No.: WO2022/159534

PCT Pub. Date: Jul. 28, 2022

(65) Prior Publication Data

US 2024/0065491 A1 Feb. 29, 2024

Related U.S. Application Data

(60) Provisional application No. 63/140,162, filed on Jan. 21, 2021.

(51) Int. Cl.
*A47K 3/40* (2006.01)
*A47K 3/02* (2006.01)

(52) U.S. Cl.
CPC . *A47K 3/40* (2013.01); *A47K 3/02* (2013.01)

(58) Field of Classification Search
CPC ..... A47K 3/40; E04H 1/12
USPC ..... 4/584
See application file for complete search history.

(56) References Cited

U.S. PATENT DOCUMENTS 2,371,754 A 3/1945 Gillum et al.
2,697,231 A * 12/1954 Strand ..... A47K 3/1605 428/116
4,551,869 A 11/1985 Whitney
5,494,718 A 2/1996 Adams et al.
(Continued)

FOREIGN PATENT DOCUMENTS

CH 374360 A 1/1964
WO WO-2016207616 A1 * 12/2016 ..... A47K 3/02

OTHER PUBLICATIONS

International Search Report mailed Apr. 6, 2022 in corresponding International Application No. PCT/US2022/013046 (2 pages).

*Primary Examiner* — Lauren A Crane
(74) *Attorney, Agent, or Firm* — Bradley Arant Boult Cummings LLP; Phillip E. Walker; Alex H. Huffstutter

(57) ABSTRACT

A shower or tub assembly comprising a shower base or bathtub having a floor comprising an upper surface and a lower surface; and a support structure coupled to the floor lower surface, wherein when the shower or tub is in use, the floor upper surface is exposed and configured for a person to sit or stand on, and the lower surface is at least partially concealed, the support structure comprises a plurality of ribs, the ribs being substantially perpendicular to the floor, and the plurality of ribs at least partially form a repeating hexagonal pattern or at least partially form a repeating triangular pattern.

19 Claims, 5 Drawing Sheets

(56) References Cited

U.S. PATENT DOCUMENTS

| | | | | |
|---|---|---|---|---|
| 6,643,863 | B1 | 11/2003 | Gerber | |
| 2014/0259362 | A1 | 9/2014 | Zimbric | |
| 2016/0362905 | A1* | 12/2016 | Harper | E04C 2/32 |
| 2017/0164788 | A1 | 6/2017 | Cohen et al. | |

* cited by examiner

SHOWER BASE OR BATHTUB

The disclosure relates to fabricated reinforced shower bases or bathtubs.

BACKGROUND

Fabricated shower bases and bathtubs may be prepared from any waterproof material, including metals, polymeric materials, fiberglass, sheet molding compound (SMC), etc. Fabricated shower bases and bathtubs are typically prepared with thin, lightweight, structurally weak walls. Desired are lightweight fabricated shower bases and bathtubs having improved strength and durability.

It has been found that certain support structures for shower bases and bathtubs provide for outstanding strength and durability.

SUMMARY

Accordingly, disclosed is a shower or tub assembly comprising a shower base or bathtub having a floor comprising an upper surface and a lower surface; and a support structure coupled to the floor lower surface, wherein when the shower or tub is in use, the floor upper surface is exposed and configured for a person to sit or stand on, and the lower surface is at least partially concealed, the support structure comprises a plurality of ribs, the ribs being substantially perpendicular to the floor, and the plurality of ribs at least partially form a repeating hexagonal pattern or at least partially form a repeating triangular pattern.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DISCLOSURE

Figure 1:
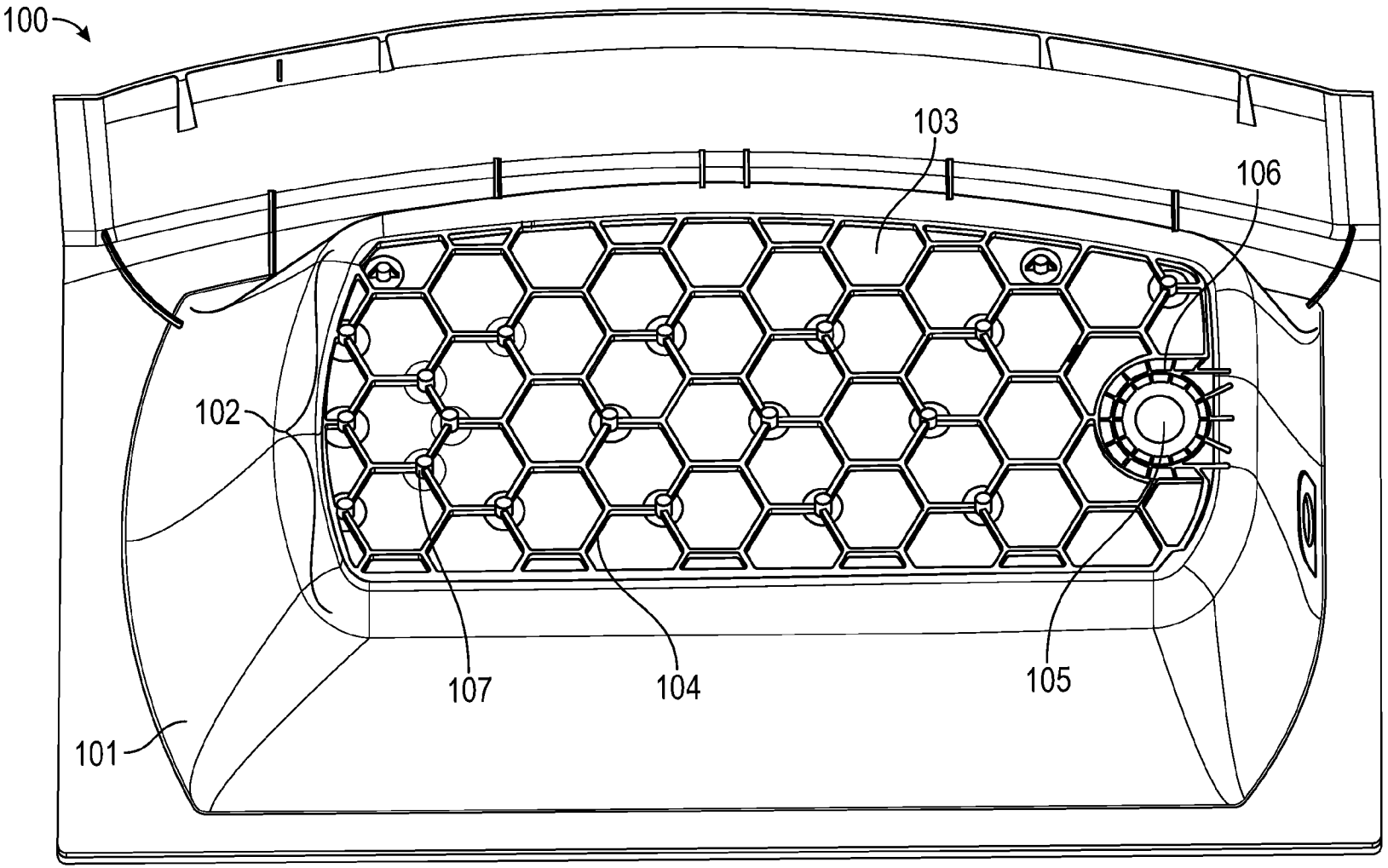
FIG. 1 shows a bathtub assembly from an underside position, according to an embodiment.

FIG. 1 shows bathtub assembly 100 from an underside, according to an embodiment. Tub assembly 100 comprises bathtub 101 and support structure 102. Support structure 102 is coupled to a lower surface of tub floor 103. Support structure 102 comprises ribs 104, which substantially form a repeating hexagonal pattern. Ribs 104 are substantially perpendicular to floor 103, forming a "T-like" structure where the horizontal top of the "T" represents a tub floor 103 lower surface portion, and where the vertical portion of the "T" represents a rib 104. Floor 103 comprises drain opening 105, which is encircled by a plurality of support ribs 106. Support structure 102 comprising drain support ribs 106 and ribs 104 may be a unitary structure, and coupled to tub 101 which may itself be a unitary structure. In other embodiments, support structure 102 and tub 101 may be formed together as a unitary structure. Support structure 102 also comprises a plurality of floor support posts 107, positioned at corners of the repeating hexagonal rib pattern.

Figure 2A:
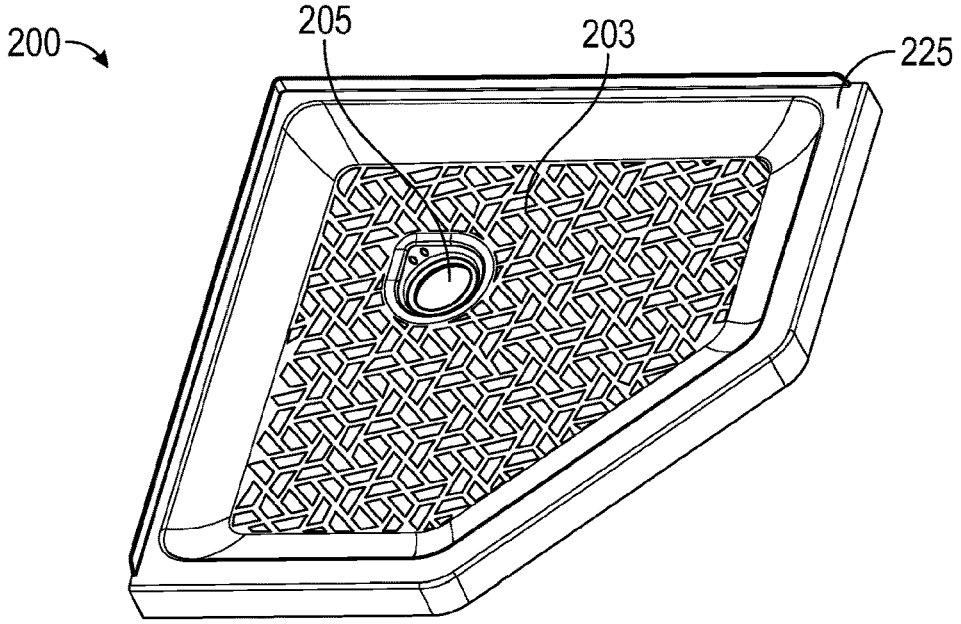
FIG. 2A and FIG. 2B show a shower base assembly, according to some embodiments.
Figure 2B:
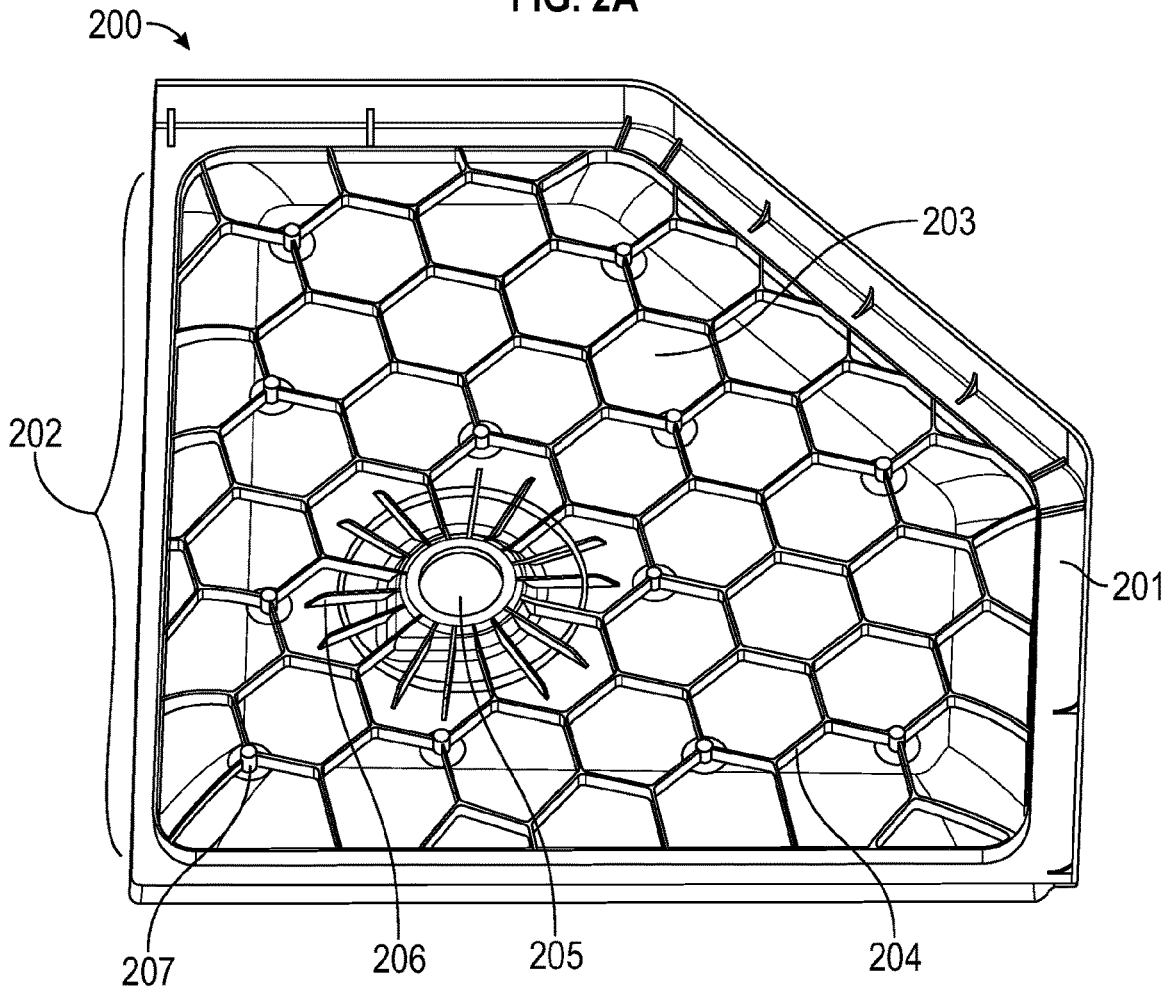

FIG. 2A shows shower base assembly 200 from a top view, according to an embodiment. Shown are shower base floor 203, drain opening 205, and raised edge 225. FIG. 2B provides an underside view of shower base assembly 200, according to an embodiment. Shown are shower pan 201 and support structure 202 coupled to a lower surface of shower pan floor 203. Support structure 202 comprises ribs 204, which substantially form a repeating hexagonal pattern. Support structure 202 also comprises a plurality of floor support posts 207, as well as a plurality of ribs 206 encircling drain opening 205.

Figure 3A:
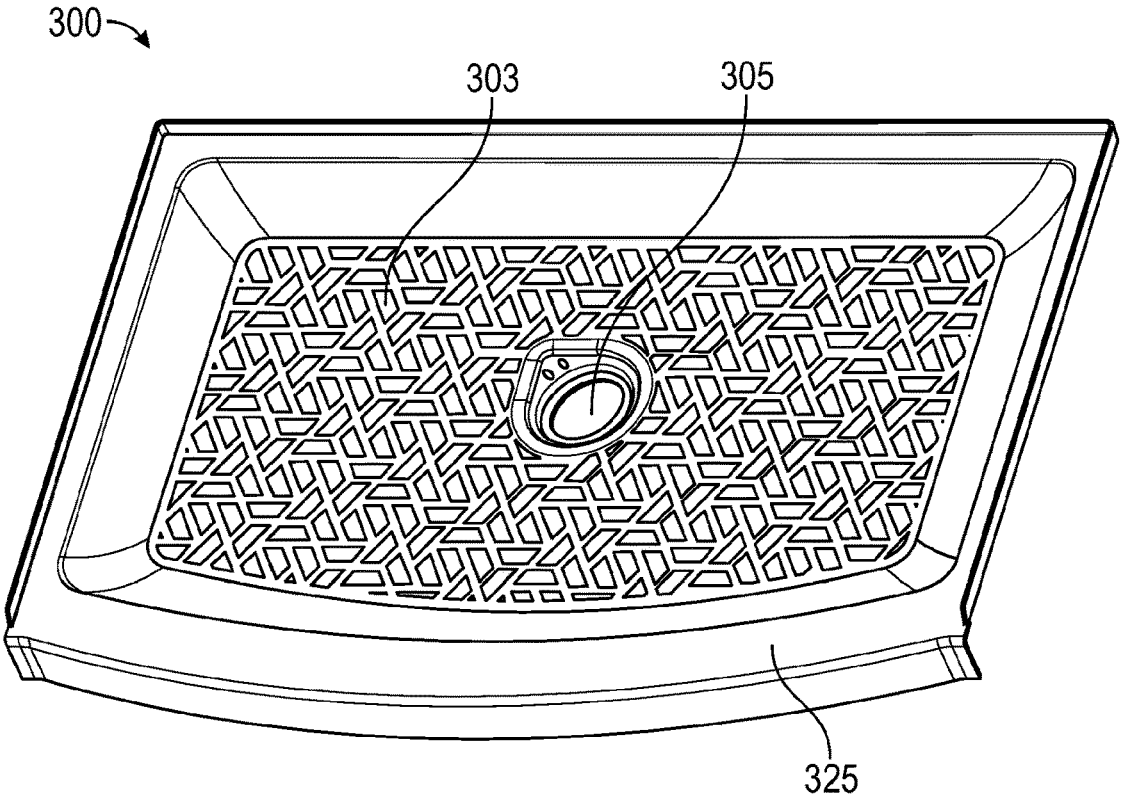
FIG. 3A, FIG. 3B, and FIG. 3C illustrate a shower base assembly according to some embodiments.
Figure 3B:
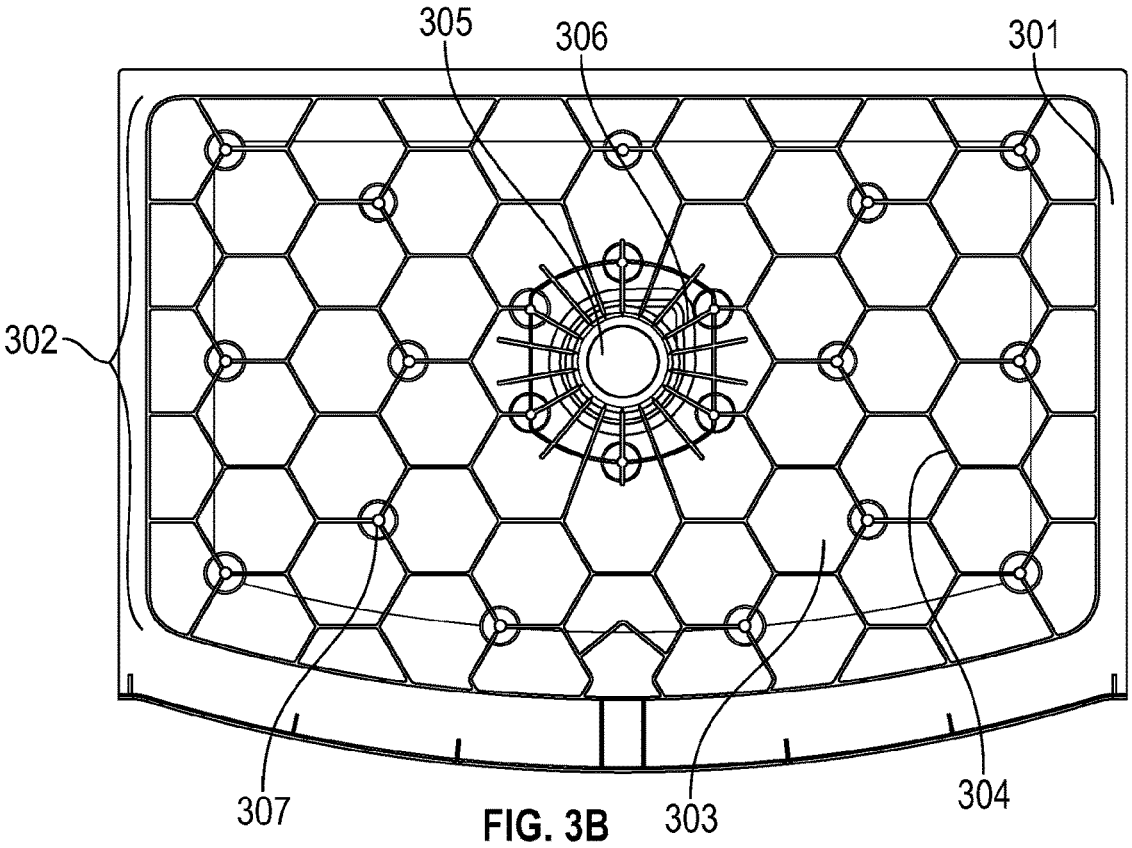
Figure 3C:
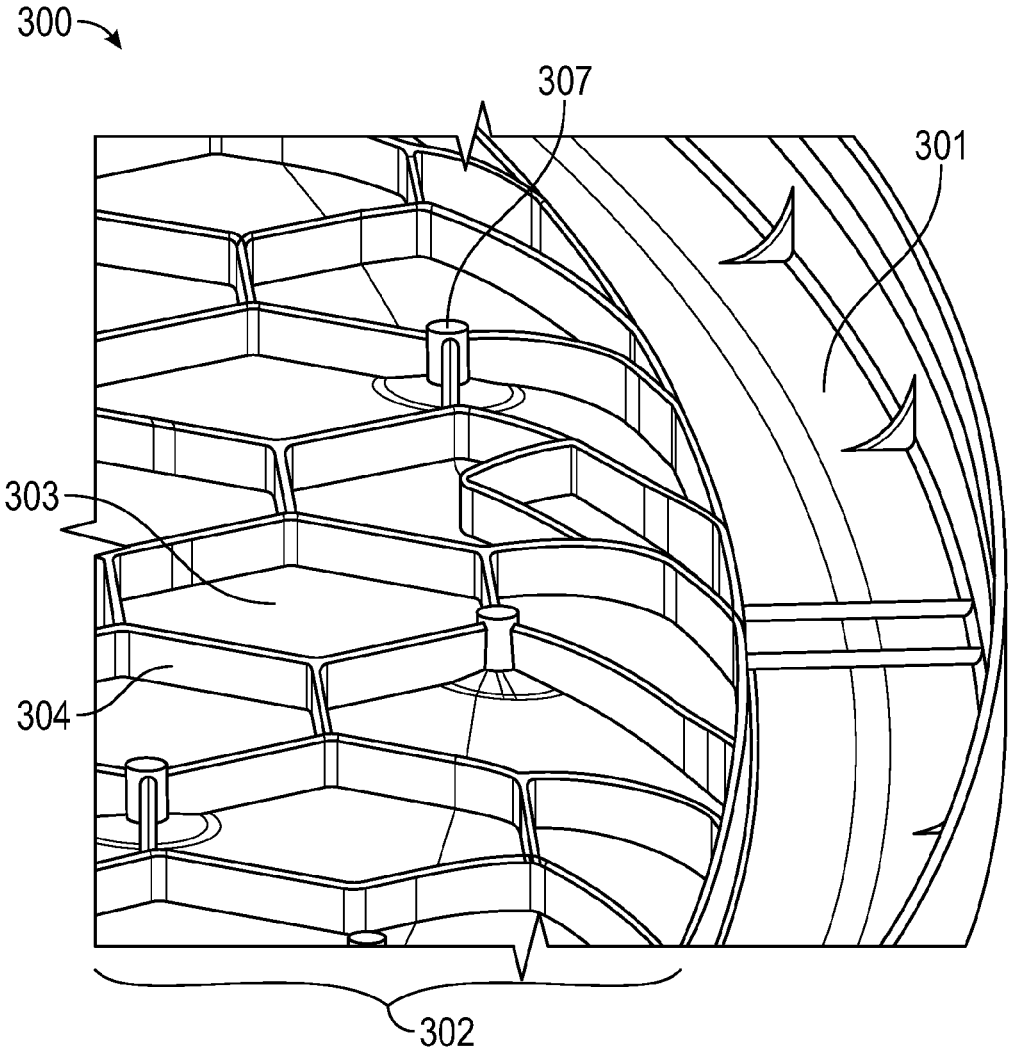

FIG. 3A provides an upper view of shower base assembly 300, according to an embodiment. Visible are shower base floor 303, drain opening 305, and shower base raised edge 325. FIG. 3B shows an underside view of shower base assembly 300, according to an embodiment. Shown are support structure 302 coupled to a lower surface of floor 303 of shower pan 301. Shower pan 301 and support structure 302 may each be a formed unitary structure and subsequently coupled together. In another embodiment, assembly 300 comprising shower pan 301 and support structure 302 may be formed together as a single unitary structure. Support structure 302 comprises ribs 304 which form a substantially repeating hexagonal pattern. Ribs 304 are substantially perpendicular to floor 303. Support structure 302 also comprises a plurality of floor support posts 307 as well as a plurality of ribs 306 positioned about drain opening 305.

A shower base or tub comprises a floor configured for a person to stand or sit on while in use. Ribs positioned on a floor lower surface support the shower base or tub floor. A rib comprises a general "I" shape where an "I top" is coupled to a shower base or tub floor lower surface, and an "I bottom" is positioned towards a bathroom floor. A rib coupled to a shower base or tub floor lower surface may be envisioned as a "T-like" shape, where the horizontal top T portion represents a floor lower surface portion and the vertical portion of the T represents the rib. A bottom of the T will be positioned towards a bathroom floor upon installation. A rib may be substantially perpendicular to a shower base or tub floor.

In some embodiments, a rib may have a height (a vertical portion of an "I" shape or of a "T" shape) of from any of about 8 mm, or less, about 9 mm, about 10 mm, about 11 mm, about 12 mm, about 13 mm, or about 14 mm, to any of about 15 mm, about 16 mm, about 17 mm, about 18 mm, about 19 mm, about 20 mm, about 21 mm, about 22 mm, about 23 mm, about 24 mm, about 25 mm, about 26 mm, about 27 mm, about 28 mm, or more.

In some embodiments, a hexagon pattern of ribs may comprise a largest dimension between two points of from any of about 75 mm, or less, about 77 mm, about 79 mm, about 81 mm, about 83 mm, about 85 mm, or about 87 mm, to any of about 89 mm, about 91 mm, about 93 mm, about 95 mm, about 97 mm, about 99 mm, about 101 mm, about 103 mm, about 105 mm, or more.

In some embodiments, a rib may have a thickness of from any of about 1.9 mm, or less, about 2.1 mm, about 2.3 mm, about 2.5 mm, about 2.7 mm, or about 2.9 mm, to any of about 3.1 mm, about 3.3 mm, about 3.5 mm, about 3.7 mm, about 3.9 mm, about 4.1 mm, about 4.3 mm, about 4.5 mm, about 4.7 mm, about 4.9 mm, about 5.1 mm, about 5.3 mm, about 5.5 mm, about 5.7 mm, about 5.9 mm, about 6.1 mm, or more. This may mean an average thickness, or a thickness at any one point.

In some embodiments, a rib top portion may comprise a greater thickness than a rib bottom portion, or vice-versa. In other embodiments, a rib may have a substantially same thickness along its vertical height. In some embodiments, a rib may comprise a thickness that gradually decreases from a rib top towards a rib bottom, or vice-versa.

In some embodiments, the term "the plurality of ribs at least partially form a repeating hexagonal pattern or at least partially form a repeating triangular pattern" may instead be stated as "the plurality of ribs comprises a repeating hexagonal pattern or comprises a repeating triangular pattern". In some embodiments, the plurality of ribs may comprise both a repeating hexagonal pattern and a repeating triangular pattern. Patterns may be regular or irregular.

In some embodiments, a support structure comprising a plurality of ribs may be a unitary construct. In some embodiments, a shower base or a bathtub may be a unitary construct. In some embodiments, a support structure unitary construct may be coupled to a shower base or a bathtub unitary construct, for example via use of an adhesive.

In certain embodiments, a shower base or bathtub and the support structure in total is a unitary construct.

In some embodiments, a shower base or bathtub and a support structure may comprise substantially the same materials, or alternatively, may comprise different materials. Materials may include fiberglass, sheet molding compound, or a thermoplastic. Thermoplastics include for example acrylonitrile-butadiene-styrene (ABS), a polyolefin, a poly (meth)acrylate, a polyurethane, a polyester, a polyamide, a polystyrene, mixtures thereof, or copolymers thereof.

In some embodiments, a support structure may comprise a plurality of floor support posts. In some embodiments, a shower base or bathtub floor comprises a drain opening (a drain), wherein a support structure comprises a plurality of ribs positioned about the drain opening (around the drain opening). A plurality of ribs positioned about a drain opening may be a unitary construct together with a plurality of ribs comprising a repeating hexagonal pattern or a repeating triangular pattern. In other embodiments, a plurality of ribs positioned about a drain opening may be a separate construct from that of a plurality of ribs comprising a repeating hexagonal pattern or a repeating triangular pattern.

In some embodiments, floor support posts are configured to rest on a bathroom floor and support a tub or shower base. In some embodiments, floor support posts may vary in length in order to adjust for a pitched tub floor or pitched shower base floor and/or to adjust for any variation in height of a bathroom floor. In some embodiments, a floor support post height may be adjustable.

In general, a plurality of ribs comprising a repeating hexagonal or triangular pattern does not contact a bathroom floor. In certain embodiments, some or all ribs positioned about a drain opening may or may not contact a bathroom floor. In some embodiments, a plurality of ribs comprising a repeating hexagonal or triangular pattern comprise substantially a same height. In some embodiments, a ribs positioned about a drain opening may comprise a same or different height from each other, in some cases to adjust for and to accommodate a height of a bathroom floor.

In some embodiments a shower base, bathtub, or support structure may be prepared via a molding technique, including compression molding, injection molding, cast molding, etc.

Following are some non-limiting embodiments of the invention.

In a first embodiment, disclosed is a shower base or tub assembly comprising a shower base or bathtub having a floor comprising an upper surface and a lower surface; and a support structure coupled to the floor lower surface, wherein when the shower or tub is in use, the floor upper surface is exposed and configured for a person to sit or stand on, and the lower surface is at least partially concealed, the support structure comprises a plurality of ribs, the ribs being substantially perpendicular to the floor, and the plurality of ribs comprise a repeating hexagonal pattern or comprise a repeating triangular pattern.

In a second embodiment, disclosed is a shower base or tub assembly according to the first embodiment, wherein the plurality of ribs comprise a repeating hexagonal pattern. In a third embodiment, disclosed is a shower base or tub assembly according to the first embodiment, wherein the plurality of ribs comprise a repeating triangular pattern.

In a fourth embodiment, disclosed is a shower base or tub assembly according to any of the preceding embodiments, wherein the support structure is a unitary construct. In a fifth embodiment, disclosed is a shower base or tub assembly according to any of the preceding embodiments, wherein the shower base or bathtub is a unitary construct. In a sixth embodiment, disclosed is a shower base or tub assembly according to any of the preceding embodiments, wherein the support structure is a unitary construct, the shower base or bathtub is a unitary construct, and the support structure is coupled to the shower base or bathtub.

In a seventh embodiment, disclosed is a shower base or tub assembly according to any of the preceding embodiments, wherein the shower base or bathtub and the support structure is a unitary construct (together are a unitary construct). In an eighth embodiment, disclosed is a shower base or tub assembly according to any of the preceding embodiments, wherein the shower base or bathtub and the support structure comprise substantially the same materials. In a ninth embodiment, disclosed is a shower base or tub assembly according to any of embodiments 1 to 7, wherein the shower base or bathtub and the support structure comprise different materials.

In a tenth embodiment, disclosed is a shower base or tub assembly according to any of the preceding embodiments, wherein the shower base or bathtub and/or the support structure comprises fiberglass or sheet molding compound. In an eleventh embodiment, disclosed is a shower base or tub assembly according to any of the preceding embodiments, wherein the shower base or bathtub and/or the support structure comprise a thermoplastic. In a twelfth embodiment, disclosed is a shower base or tub assembly according to embodiment 11, wherein the thermoplastic comprises acrylonitrile-butadiene-styrene, a polyolefin, a poly(meth)acrylate, a polyurethane, a polyester, a polyamide, a polystyrene, mixtures thereof, or copolymers thereof.

In a thirteenth embodiment, disclosed is a shower base or tub assembly according to any of the preceding embodiments, wherein the support structure comprises a plurality of floor support posts. In a fourteenth embodiment, disclosed is a shower base or tub assembly according to any of the preceding embodiments, wherein the support structure comprises a plurality of floor support posts, the support posts having a varying height to adjust for a pitch of the shower base or bathtub floor.

In a fifteenth embodiment, disclosed is a shower base or tub assembly according to any of the preceding embodiments, wherein the floor comprises a drain opening, and wherein the support structure comprises a plurality of ribs positioned about the drain opening. In a sixteenth embodiment, disclosed is a shower base or tub assembly according to any of the preceding embodiments, wherein the ribs comprise a height of from about 8 mm to about 28 mm.

In a seventeenth embodiment, disclosed is a shower base or tub assembly according to any of the preceding embodiments, wherein a largest dimension of a hexagon of a repeating hexagonal pattern is from about 75 mm to about 105 mm.

In an eighteenth embodiment, disclosed is a shower base or tub assembly according to any of the preceding embodiments, wherein the ribs comprise a thickness of from about 1.9 mm to about 6.1 mm. In a nineteenth embodiment, disclosed is a shower base or tub assembly according to any of the preceding embodiments, wherein the ribs comprise a thickness that gradually decreases from a rib top towards a rib bottom.

In a twentieth embodiment, disclosed is a support structure according to any of the preceding embodiments.

The term "adjacent" may mean "near" or "close-by" or "next to".

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

Example Finite Element Analysis

Figure 4A:
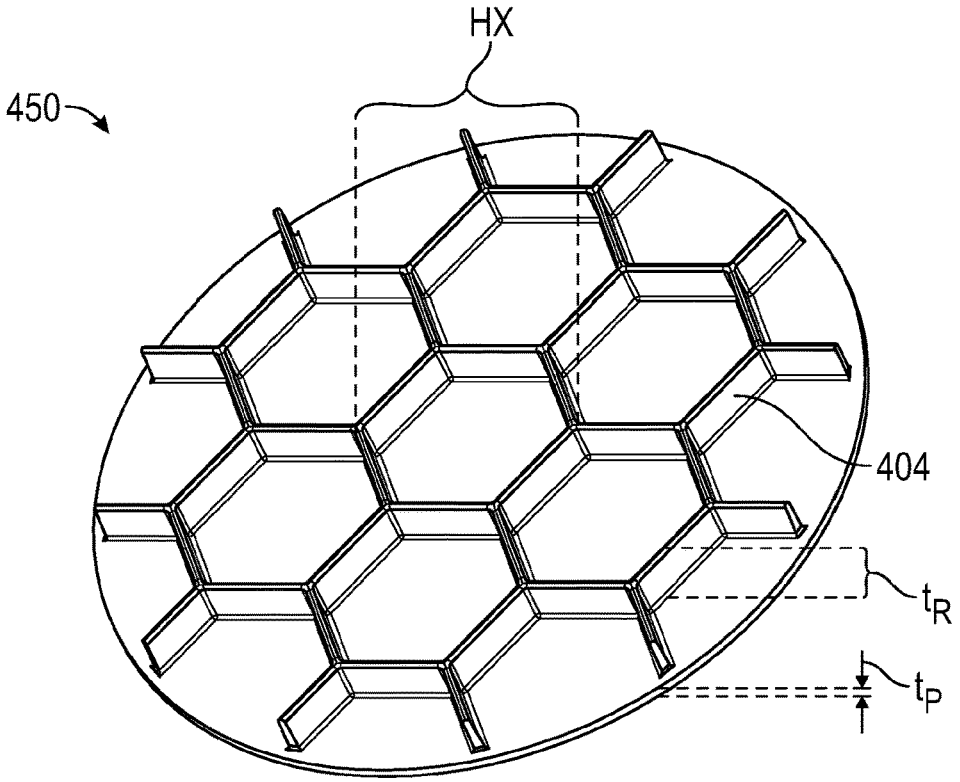
FIG. 4A and FIG. 4B show test SMC plates of the Example.
Figure 4B:
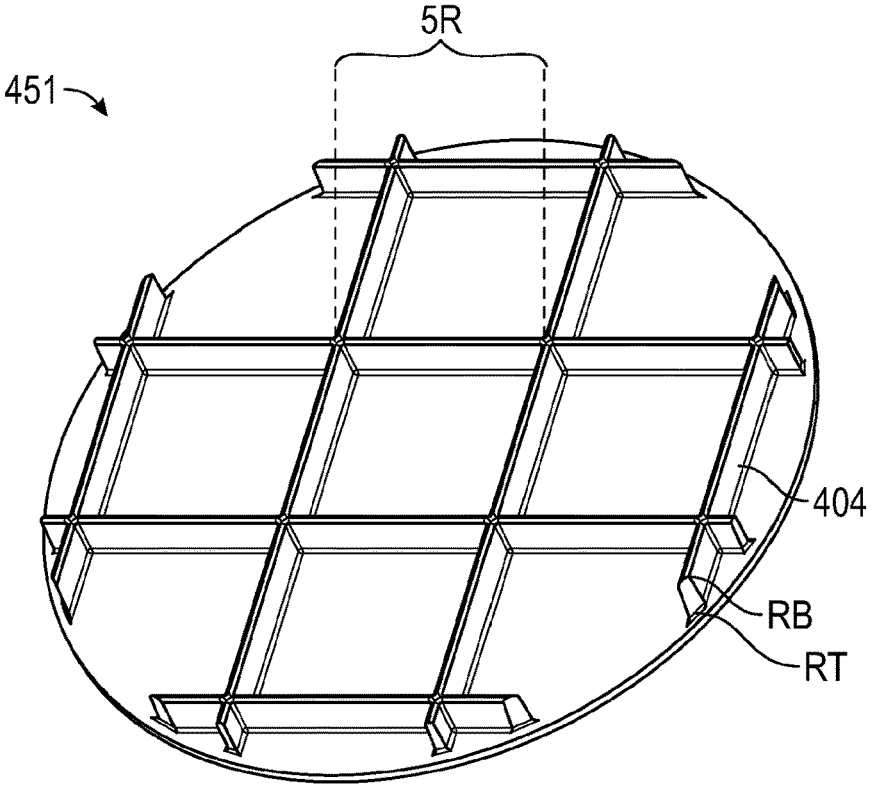

Circular plates having a support structure comprising a plurality of ribs forming a repeating hexagonal pattern are compared to circular plates having a support structure comprising a plurality of ribs forming a repeating square pattern. The plates are of unitary structure and are prepared from sheet molding compound (SMC) having about 11% fiber, about 57% filler, and about 31% resin, by weight. Plates represent a shower base or tub floor. Test plate 450 and control plate 451 are depicted in FIG. 4A and FIG. 4B. Test plate 450 of the invention comprises ribs 404 forming a repeating hexagonal pattern, and control plate 451 comprises ribs 404 forming a repeating square pattern. The thickness of plates 450 and 451, tP is 5 mm. Ribs 404 have a vertical dimension (height) tR of 18 mm. Ribs 404 have a thickness at a top section RT of 4.2 mm and a thickness at a bottom section RB of 3.1 mm. A maximum dimension HX of a hexagon is 90 mm. A maximum dimension of a square portion SQ is 88 mm. A total perimeter of each plate is about 1766 mm. A total volume between ribs of plates 450 and 451 are equivalent at about 531.5 $cm^3$ (32.4 $in^3$). Accordingly, plates 450 and 451 will have a same weight.

Plates 450 and 451 are compared with Finite Element Analysis (FEA). Testing is performed with a 3000 pound load on a 3 inch circle in the center of a test plate. Results are below.

| | total deformation (mm) | maximum stress (MPa) |
|---|---|---|
| 450 hexagonal | 1.04 | 46.6 |
| 451 square | 1.15 | 76.1 |

It is seen a present hexagonal rib pattern is superior to a comparable square rib pattern towards providing support to a floor. The plate having a square rib pattern deflects about 11% more than the plate having a hexagonal rib pattern under stress. The plate having a square rib pattern exhibits a maximum stress level about 63% higher than that of a plate having a hexagonal rib pattern.

The invention claimed is:

1. A shower base or tub assembly comprising a shower base or bathtub having a floor comprising an upper surface and a lower surface; and a support structure coupled to the floor lower surface, wherein when the shower or tub is in use, the floor upper surface is exposed and configured for a person to sit or stand on, and the lower surface is at least partially concealed, the support structure comprises a plurality of ribs, the ribs being substantially perpendicular to the floor, and the plurality of ribs defining a repeating hexagonal pattern, and the support structure further comprises a plurality of floor support posts, each floor support post being located at an intersection node of the repeating hexagonal pattern; wherein each floor support post is positioned at a junction of three ribs of the repeating hexagonal pattern.

2. The shower base or tub assembly according to claim 1, wherein the plurality of ribs and the plurality of floor support posts cooperate to distribute a load applied to the floor across multiple adjacent hexagonal cells of the repeating hexagonal pattern.

3. The shower base or tub assembly according to claim 1, wherein the support structure comprises a plurality of floor support posts.

4. The shower base or tub assembly according to claim 1, wherein the support structure comprises a plurality of floor support posts, the support posts having a varying height to adjust for a pitch of the shower base or bathtub floor.

5. The shower base or tub assembly according to claim 1, wherein the floor comprises a drain opening, and wherein the support structure comprises a plurality of ribs positioned about the drain opening.

6. The shower base or tub assembly according to claim 1, wherein the ribs comprise a height of from about 8 mm to about 28 mm.

7. The shower base or tub assembly according to claim 1, wherein the plurality of ribs and the plurality of floor support posts are integrally formed as a unitary structure.

8. The shower base or tub assembly according to claim 1, wherein the ribs comprise a thickness of from about 1.9 mm to about 6.1 mm.

9. The shower base or tub assembly according to claim 1, wherein the ribs comprise a thickness that gradually decreases from a rib top towards a rib bottom.

10. The shower base or tub assembly according to claim 1, wherein the support structure is a unitary construct.

11. The shower base or tub assembly according to claim 1, wherein the shower base or bathtub is a unitary construct.

12. The shower base or tub assembly according to claim 1, wherein the support structure is a unitary construct, the shower base or bathtub is a unitary construct, and the support structure is coupled to the shower base or bathtub.

13. The shower base or tub assembly according to claim 1, wherein the shower base or bathtub and the support structure is a unitary construct.

14. The shower base or tub assembly according to claim 1, wherein the shower base or bathtub and the support structure comprise substantially the same materials.

15. The shower base or tub assembly according to claim 1, wherein the shower base or bathtub and the support structure comprise different materials.

16. The shower base or tub assembly according to claim 1, wherein the shower base or bathtub and/or the support structure comprises fiberglass or sheet molding compound.

17. The shower base or tub assembly according to claim 1, wherein the shower base or bathtub and/or the support structure comprise a thermoplastic.

18. The shower base or tub assembly according to claim 17, wherein the thermoplastic comprises acrylonitrile-butadiene-styrene, a polyolefin, a poly(meth)acrylate, a polyurethane, a polyester, a polyamide, a polystyrene, mixtures thereof, or copolymers thereof.

19. A support structure according to claim 1.

* * * * *